US007971368B2

(12) United States Patent
Fukaya et al.

(10) Patent No.: US 7,971,368 B2
(45) Date of Patent: Jul. 5, 2011

(54) HAND DRYING APPARATUS

(75) Inventors: Yoshihiro Fukaya, Tokyo (JP); Syunichi Mori, Tokyo (JP); Yasuyuki Itoigawa, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 541 days.

(21) Appl. No.: 11/884,122

(22) PCT Filed: Jul. 26, 2005

(86) PCT No.: PCT/JP2005/013652

§ 371 (c)(1),
(2), (4) Date: Aug. 10, 2007

(87) PCT Pub. No.: WO2007/013142

PCT Pub. Date: Feb. 1, 2007

(65) Prior Publication Data

US 2008/0263889 A1 Oct. 30, 2008

(51) Int. Cl.
*F26B 21/06* (2006.01)

(52) U.S. Cl. ..... 34/77; 34/565; 34/572; 34/202; 222/1; 222/52; 4/623; 73/23.2; 73/53.01; 436/45; 436/180; 705/1; 705/14

(58) Field of Classification Search ..... 34/77, 565, 34/57, 2, 202; 222/52, 1; 396/626, 571; 4/623; 73/23.2, 53; 436/45, 180; 705/1, 705/14

See application file for complete search history.

(56) References Cited

U.S. PATENT DOCUMENTS

| | | | | | |
|---|---|---|---|---|---|
| 1,531,940 | A | * | 3/1925 | Hoeflich | 118/60 |
| 1,561,599 | A | * | 11/1925 | Eppler | 200/33 R |
| 1,577,859 | A | * | 3/1926 | Woodard | 239/282 |
| 1,961,179 | A | * | 6/1934 | Tinkham | 34/202 |
| 1,997,387 | A | * | 4/1935 | McCord | 34/202 |
| 2,013,572 | A | * | 9/1935 | McCord | 392/380 |
| 2,022,593 | A | * | 11/1935 | Fuykers | 34/444 |
| 2,225,505 | A | * | 12/1940 | Offen | 34/465 |
| 2,264,329 | A | * | 12/1941 | Offen | 34/655 |
| 2,281,370 | A | * | 4/1942 | Morrison et al. | 34/87 |
| 2,504,740 | A | * | 4/1950 | Siegel | 222/192 |
| 2,634,514 | A | * | 4/1953 | Clemens | 34/202 |
| 2,817,000 | A | * | 12/1957 | Scheid | 392/383 |
| 2,853,591 | A | * | 9/1958 | Fine | 392/381 |
| 2,859,535 | A | * | 11/1958 | Carlson | 34/562 |
| 2,965,974 | A | * | 12/1960 | Jackson | 34/225 |
| 2,991,560 | A | * | 7/1961 | Cota | 34/87 |
| 3,006,079 | A | * | 10/1961 | Jepson | 34/99 |

(Continued)

FOREIGN PATENT DOCUMENTS

DE 3643346 A1 * 6/1988

(Continued)

OTHER PUBLICATIONS

PCT/ISA/210, for PCT/JP2005/013652 dated Oct. 2005.

(Continued)

*Primary Examiner* — Stephen M. Gravini
(74) *Attorney, Agent, or Firm* — Buchanan Ingersoll & Rooney PC

(57) ABSTRACT

In a hand drying apparatus, an infrared light absorber absorbs infrared light, when a hand is not present, emitted from an infrared light emitter provided on an inner surface of a drying space.

9 Claims, 4 Drawing Sheets

U.S. PATENT DOCUMENTS

| | | | | | |
|---|---|---|---|---|---|
| 3,076,887 | A | * | 2/1963 | Bulow | 392/381 |
| 3,100,143 | A | * | 8/1963 | Doggett et al. | 34/331 |
| 3,131,281 | A | * | 4/1964 | Jepson | 392/383 |
| 3,603,002 | A | * | 9/1971 | Spierer | 34/202 |
| 3,643,346 | A | * | 2/1972 | Lester | 34/202 |
| 4,015,366 | A | * | 4/1977 | Hall, III | 47/1.43 |
| 4,271,602 | A | * | 6/1981 | Grolms | 34/655 |
| RE31,023 | E | * | 9/1982 | Hall, III | 405/37 |
| 4,497,999 | A | * | 2/1985 | Postbeschild | 392/381 |
| 4,670,010 | A | * | 6/1987 | Dragone | 604/289 |
| 4,704,806 | A | * | 11/1987 | Gresens | 34/570 |
| 4,756,094 | A | * | 7/1988 | Houck, Jr. | 34/225 |
| 4,785,162 | A | * | 11/1988 | Kuo | 392/381 |
| 4,826,262 | A | * | 5/1989 | Hartman et al. | 312/34.12 |
| 4,871,900 | A | * | 10/1989 | Hickman | 392/380 |
| 4,893,741 | A | * | 1/1990 | Heinzmann | 242/615 |
| 4,999,927 | A | * | 3/1991 | Durst et al. | 34/448 |
| 5,009,016 | A | * | 4/1991 | LePisto et al. | 34/421 |
| 5,217,035 | A | * | 6/1993 | Van Marcke | 137/1 |
| 5,305,916 | A | * | 4/1994 | Suzuki et al. | 222/52 |
| 5,307,109 | A | * | 4/1994 | Miyasaka et al. | 396/571 |
| 5,351,417 | A | * | 10/1994 | Rubin | 34/90 |
| 5,397,028 | A | * | 3/1995 | Jesadanont | 222/1 |
| 5,400,105 | A | * | 3/1995 | Koboshi et al. | 396/632 |
| 5,420,102 | A | * | 5/1995 | Harshavardhan et al. | 505/237 |
| 5,438,763 | A | * | 8/1995 | Yang | 34/90 |
| 5,452,045 | A | * | 9/1995 | Koboshi et al. | 396/626 |
| 5,459,944 | A | * | 10/1995 | Tatsutani et al. | 34/202 |
| 5,472,510 | A | * | 12/1995 | Harshavardhan et al. | 118/730 |
| 5,552,851 | A | * | 9/1996 | Koboshi et al. | 396/568 |
| 5,568,691 | A | * | 10/1996 | Rubin | 34/98 |
| 5,640,781 | A | * | 6/1997 | Carson | 34/97 |
| 5,647,074 | A | * | 7/1997 | White et al. | 4/664 |
| 5,661,912 | A | * | 9/1997 | Bhatnagar et al. | 34/270 |
| 5,689,751 | A | * | 11/1997 | Ueda | 396/626 |
| 5,694,653 | A | * | 12/1997 | Harald | 4/623 |
| 5,781,942 | A | * | 7/1998 | Allen et al. | 4/623 |
| 5,818,131 | A | * | 10/1998 | Zhang | 310/15 |
| 5,873,178 | A | * | 2/1999 | Johnson | 34/90 |
| 5,873,179 | A | * | 2/1999 | Gregory et al. | 34/90 |
| 5,937,761 | A | * | 8/1999 | Buschmann et al. | 101/424.1 |
| 5,952,924 | A | * | 9/1999 | Evans et al. | 340/573.1 |
| 5,963,135 | A | * | 10/1999 | Van Marcke | 340/573.1 |
| 5,966,753 | A | * | 10/1999 | Gauthier et al. | 4/623 |
| 6,021,584 | A | * | 2/2000 | Schwartz | 34/666 |
| 6,038,786 | A | * | 3/2000 | Aisenberg et al. | 34/267 |
| 6,067,673 | A | * | 5/2000 | Paese et al. | 4/623 |
| 6,076,392 | A | * | 6/2000 | Drzewiecki | 73/23.2 |
| 6,079,118 | A | * | 6/2000 | Kiyokawa | 34/134 |
| 6,086,773 | A | * | 7/2000 | Dufresne et al. | 216/8 |
| 6,161,301 | A | * | 12/2000 | Hoshi et al. | 34/111 |
| 6,185,838 | B1 | * | 2/2001 | Moore | 34/202 |
| 6,206,340 | B1 | * | 3/2001 | Paese et al. | 251/129.04 |
| 6,215,116 | B1 | * | 4/2001 | Van Marcke | 250/221 |
| 6,236,953 | B1 | * | 5/2001 | Segal | 702/127 |
| 6,250,132 | B1 | * | 6/2001 | Drzewiecki | 73/23.2 |
| 6,269,552 | B1 | * | 8/2001 | Honda et al. | 34/317 |
| 6,272,905 | B1 | * | 8/2001 | Drzewiecki | 73/53.01 |
| 6,279,777 | B1 | * | 8/2001 | Goodin et al. | 222/52 |
| 6,305,034 | B1 | * | 10/2001 | Perez Urrutia | 4/300.3 |
| 6,305,212 | B1 | * | 10/2001 | Drzewiecki | 73/23.2 |
| 6,325,475 | B1 | * | 12/2001 | Hayes et al. | 347/2 |
| 6,347,724 | B1 | * | 2/2002 | Chen et al. | 222/1 |
| 6,388,609 | B2 | * | 5/2002 | Paese et al. | 342/27 |
| 6,423,184 | B2 | * | 7/2002 | Vahatalo et al. | 162/198 |
| 6,432,365 | B1 | * | 8/2002 | Levin et al. | 422/509 |
| 6,467,651 | B1 | * | 10/2002 | Muderlak et al. | 222/52 |
| 6,503,457 | B1 | * | 1/2003 | Neeper et al. | 422/527 |
| 6,537,459 | B1 | * | 3/2003 | Dufresne et al. | 216/8 |
| 6,568,655 | B2 | * | 5/2003 | Paese et al. | 251/129.04 |
| 6,569,288 | B1 | * | 5/2003 | Linnonmaa et al. | 162/207 |
| 6,577,240 | B2 | * | 6/2003 | Armstrong | 340/573.1 |
| 6,609,674 | B2 | * | 8/2003 | Gabrys | 242/437.3 |
| 6,651,356 | B1 | * | 11/2003 | Buehring | 34/254 |
| 6,651,851 | B2 | * | 11/2003 | Muderlak et al. | 222/333 |
| 6,731,209 | B2 | * | 5/2004 | Wadlow et al. | 340/562 |
| 6,751,886 | B2 | * | 6/2004 | Chang et al. | 34/96 |
| 6,769,197 | B1 | * | 8/2004 | Tai | 34/90 |
| 6,801,836 | B2 | * | 10/2004 | Schanin | 700/295 |
| 6,808,935 | B2 | * | 10/2004 | Levin et al. | 436/180 |
| 6,824,738 | B1 | * | 11/2004 | Neeper et al. | 422/72 |
| 6,888,143 | B2 | * | 5/2005 | Vogt et al. | 250/341.1 |
| 6,905,645 | B2 | * | 6/2005 | Iskra | 264/128 |
| 6,929,150 | B2 | * | 8/2005 | Muderlak et al. | 222/1 |
| 6,951,147 | B2 | * | 10/2005 | Call et al. | 73/863.22 |
| 6,975,926 | B2 | * | 12/2005 | Schanin | 700/296 |
| 6,981,499 | B2 | * | 1/2006 | Anderson et al. | 128/200.23 |
| 6,986,654 | B2 | * | 1/2006 | Imiolek et al. | 425/182 |
| 6,992,718 | B1 | * | 1/2006 | Takahara | 348/333.09 |
| 6,992,759 | B2 | * | 1/2006 | Nakayama et al. | 356/244 |
| 6,995,670 | B2 | * | 2/2006 | Wadlow et al. | 340/562 |
| 7,008,209 | B2 | * | 3/2006 | Iskra et al. | 425/182 |
| 7,027,887 | B2 | * | 4/2006 | Gaylo et al. | 700/117 |
| 7,038,164 | B2 | * | 5/2006 | Denney et al. | 219/121.67 |
| 7,038,166 | B2 | * | 5/2006 | Denney et al. | 219/121.86 |
| 7,039,301 | B1 | * | 5/2006 | Aisenberg et al. | 392/380 |
| 7,057,134 | B2 | * | 6/2006 | Denney et al. | 219/121.78 |
| 7,060,932 | B2 | * | 6/2006 | Denney et al. | 219/121.6 |
| 7,073,442 | B2 | * | 7/2006 | Fedor et al. | 101/480 |
| 7,075,629 | B2 | * | 7/2006 | Bonne et al. | 356/43 |
| 7,122,076 | B2 | * | 10/2006 | Vonwiller et al. | 106/31.13 |
| 7,138,391 | B2 | * | 11/2006 | Vonwiller et al. | 514/185 |
| 7,141,812 | B2 | * | 11/2006 | Appleby et al. | 250/505.1 |
| 7,148,345 | B2 | * | 12/2006 | Vonwiller et al. | 540/145 |
| 7,153,956 | B2 | * | 12/2006 | Vonwiller et al. | 540/145 |
| 7,156,016 | B2 | * | 1/2007 | Schrader et al. | 100/213 |
| 7,157,285 | B2 | * | 1/2007 | Neeper et al. | 436/45 |
| 7,177,725 | B2 | * | 2/2007 | Nortier et al. | 700/282 |
| 7,180,920 | B2 | * | 2/2007 | Denney et al. | 372/38.02 |
| 7,204,941 | B2 | * | 4/2007 | Hall et al. | 252/587 |
| 7,228,874 | B2 | * | 6/2007 | Bolderheij et al. | 137/801 |
| 7,236,271 | B2 | * | 6/2007 | Silverbrook | 358/473 |
| 7,271,209 | B2 | * | 9/2007 | Li et al. | 524/284 |
| 7,278,727 | B2 | * | 10/2007 | Vonwiller et al. | 347/100 |
| 7,278,813 | B2 | * | 10/2007 | Davis et al. | 414/416.03 |
| 7,282,164 | B2 | * | 10/2007 | Hall et al. | 252/587 |
| 7,286,223 | B2 | * | 10/2007 | Denney et al. | 356/318 |
| 7,289,206 | B2 | * | 10/2007 | Denney et al. | 356/318 |
| 7,367,665 | B2 | * | 5/2008 | Vonwiller et al. | 347/100 |
| 7,379,483 | B2 | * | 5/2008 | Denney et al. | 372/38.02 |
| 7,389,638 | B2 | * | 6/2008 | Weissman et al. | 60/286 |
| 7,392,950 | B2 | * | 7/2008 | Walmsley et al. | 235/462.07 |
| 7,410,606 | B2 | * | 8/2008 | Appleby et al. | 264/219 |
| 7,411,204 | B2 | * | 8/2008 | Appleby et al. | 250/505.1 |
| 7,417,141 | B2 | * | 8/2008 | Vonwiller et al. | 540/145 |
| 7,423,145 | B2 | * | 9/2008 | Vonwiller et al. | 540/145 |
| 7,435,390 | B2 | * | 10/2008 | Cracauer et al. | 422/130 |
| 7,437,833 | B2 | * | 10/2008 | Sato et al. | 34/90 |
| 7,447,908 | B2 | * | 11/2008 | Lapstun et al. | 713/176 |
| 7,452,989 | B2 | * | 11/2008 | Vonwiller et al. | 540/145 |
| 7,456,277 | B2 | * | 11/2008 | Vonwiller et al. | 540/145 |
| 7,462,852 | B2 | * | 12/2008 | Appleby et al. | 250/505.1 |
| 7,465,342 | B2 | * | 12/2008 | Hall et al. | 106/31.13 |
| 7,466,444 | B2 | * | 12/2008 | Silverbrook et al. | 358/1.18 |
| 7,470,315 | B2 | * | 12/2008 | Vonwiller et al. | 106/31.49 |
| 7,477,148 | B2 | * | 1/2009 | Lynn et al. | 340/540 |
| 7,481,453 | B2 | * | 1/2009 | Breed | 280/738 |
| 7,492,453 | B2 | * | 2/2009 | Denney et al. | 356/318 |
| 7,500,268 | B2 | * | 3/2009 | Silverbrook et al. | 726/26 |
| 7,518,136 | B2 | * | 4/2009 | Appleby et al. | 250/505.1 |
| 7,533,787 | B2 | * | 5/2009 | Muderlak et al. | 222/333 |
| 7,555,363 | B2 | * | 6/2009 | Augenbraun et al. | 700/253 |
| 7,558,962 | B2 | * | 7/2009 | Silverbrook et al. | 713/176 |
| 7,559,983 | B2 | * | 7/2009 | Starling et al. | 106/31.49 |
| 7,562,965 | B2 | * | 7/2009 | Silverbrook et al. | 347/50 |
| 7,566,363 | B2 | * | 7/2009 | Starling et al. | 106/31.49 |
| 7,572,327 | B2 | * | 8/2009 | Vonwiller et al. | 106/31.49 |
| 7,575,784 | B1 | * | 8/2009 | Bi et al. | 427/567 |
| 7,579,064 | B2 | * | 8/2009 | Vonwiller et al. | 428/195.1 |
| 7,596,883 | B2 | * | 10/2009 | Kameishi | 34/90 |
| 7,611,317 | B2 | * | 11/2009 | Muderlak et al. | 411/522 |
| 7,620,085 | B2 | * | 11/2009 | Denney et al. | 372/38.02 |
| 7,625,198 | B2 | * | 12/2009 | Lipson et al. | 425/174 |
| 7,628,467 | B2 | * | 12/2009 | Silverbrook | 347/32 |
| 7,658,792 | B2 | * | 2/2010 | Indusegaram et al. | 106/31.49 |
| 7,699,920 | B2 | * | 4/2010 | Vonwiller et al. | 106/31.49 |
| 7,709,633 | B2 | * | 5/2010 | Indusegaram et al. | 540/145 |

7,715,036 B2 * 5/2010 Silverbrook et al. ..... 358/1.15
7,727,723 B2 * 6/2010 Pollack et al. ..... 435/6
7,737,271 B2 * 6/2010 Vonwiller et al. ..... 540/145
7,737,397 B2 * 6/2010 Morrisroe ..... 250/288
7,742,167 B2 * 6/2010 Morrisroe ..... 356/316
7,750,147 B2 * 7/2010 Vonwiller et al. ..... 540/140
7,753,517 B2 * 7/2010 King et al. ..... 347/109
7,763,471 B2 * 7/2010 Pamula et al. ..... 436/86
7,774,096 B2 * 8/2010 Goerg et al. ..... 700/236
7,783,380 B2 * 8/2010 York et al. ..... 700/240
7,785,098 B1 * 8/2010 Appleby et al. ..... 425/470
7,785,502 B2 * 8/2010 Ridley et al. ..... 252/587
7,794,049 B2 * 9/2010 Silverbrook et al. ..... 347/42
7,806,513 B2 * 10/2010 Silverbrook et al. ..... 347/50
7,815,871 B2 * 10/2010 Pamula et al. ..... 422/404
7,816,121 B2 * 10/2010 Pollack et al. ..... 435/286.5
7,824,484 B2 * 11/2010 Indusegaram et al. ..... 106/31.49
7,825,108 B2 * 11/2010 Vonwiller et al. ..... 514/185
7,837,775 B2 * 11/2010 Vonwiller et al. ..... 106/31.49
7,841,537 B2 * 11/2010 Starling et al. ..... 235/491
7,851,184 B2 * 12/2010 Pollack et al. ..... 435/91.2
7,864,315 B2 * 1/2011 Denney et al. ..... 356/318
7,874,659 B2 * 1/2011 Silverbrook et al. ..... 347/86
7,875,173 B1 * 1/2011 Barnes ..... 210/198.1
7,880,114 B2 * 2/2011 Denney et al. ..... 219/121.6
7,880,116 B2 * 2/2011 Denney et al. ..... 219/121.67
7,880,877 B2 * 2/2011 Denney et al. ..... 356/302
2001/0009404 A1 * 7/2001 Paese et al. ..... 342/28
2002/0000449 A1 * 1/2002 Armstrong ..... 222/52
2002/0007510 A1 * 1/2002 Mann ..... 4/300
2002/0019709 A1 * 2/2002 Segal ..... 702/45
2002/0037588 A1 * 3/2002 Neeper et al. ..... 436/45
2002/0056782 A1 * 5/2002 Gabrys ..... 242/437.3
2002/0090729 A1 * 7/2002 Neeper et al. ..... 436/45
2002/0090737 A1 * 7/2002 Levin et al. ..... 436/180
2002/0142454 A1 * 10/2002 Cracauer et al. ..... 435/287.2
2002/0156255 A1 * 10/2002 Cracauer ..... 536/23.1
2002/0171056 A1 * 11/2002 Paese et al. ..... 251/129.04
2002/0175814 A1 * 11/2002 Wadlow et al. ..... 340/562
2002/0185500 A1 * 12/2002 Muderlak et al. ..... 222/1
2003/0000524 A1 * 1/2003 Anderson et al. ..... 128/203.23
2003/0007891 A1 * 1/2003 Wilson ..... 422/56
2003/0009264 A1 * 1/2003 Schanin ..... 700/291
2003/0040683 A1 * 2/2003 Rule et al. ..... 600/584
2003/0072689 A1 * 4/2003 Cracauer et al. ..... 422/131
2003/0113236 A1 * 6/2003 Cracauer et al. ..... 422/131
2003/0113237 A1 * 6/2003 Cracauer et al. ..... 422/134
2003/0121906 A1 * 7/2003 Abbott et al. ..... 219/543
2003/0124526 A1 * 7/2003 Cracauer et al. ..... 435/6
2003/0128812 A1 * 7/2003 Appleby et al. ..... 378/147
2003/0128813 A1 * 7/2003 Appleby et al. ..... 378/147
2003/0150126 A1 * 8/2003 Chang et al. ..... 34/96
2003/0168614 A1 * 9/2003 Vogt et al. ..... 250/492.1
2003/0209404 A1 * 11/2003 Davis et al. ..... 198/345.3
2003/0228415 A1 * 12/2003 Bi et al. ..... 427/180
2003/0235272 A1 * 12/2003 Appleby et al. ..... 378/147
2004/0003738 A1 * 1/2004 Imiolek et al. ..... 101/480
2004/0003741 A1 * 1/2004 Iskra et al. ..... 101/487
2004/0004303 A1 * 1/2004 Iskra ..... 264/109
2004/0004653 A1 * 1/2004 Pryor et al. ..... 347/106
2004/0005182 A1 * 1/2004 Gaylo et al. ..... 400/283
2004/0025604 A1 * 2/2004 Call et al. ..... 73/863.22
2004/0026359 A1 * 2/2004 Dufresne et al. ..... 216/8
2004/0050876 A1 * 3/2004 Muderlak et al. ..... 222/333
2004/0056779 A1 * 3/2004 Rast ..... 340/985
2004/0064218 A1 * 4/2004 Schanin et al. ..... 700/286
2004/0071595 A1 * 4/2004 Neeper et al. ..... 422/72
2004/0085206 A1 * 5/2004 Wadlow et al. ..... 340/562
2004/0093125 A1 * 5/2004 Schanin ..... 700/296
2004/0118309 A1 * 6/2004 Fedor et al. ..... 101/480
2004/0149733 A1 * 8/2004 Abbott et al. ..... 219/535
2004/0156478 A1 * 8/2004 Appleby et al. ..... 378/147
2004/0182839 A1 * 9/2004 Denney et al. ..... 219/121.78
2004/0182840 A1 * 9/2004 Denney et al. ..... 219/121.78
2004/0182841 A1 * 9/2004 Denney et al. ..... 219/121.78
2004/0182842 A1 * 9/2004 Denney et al. ..... 219/121.84
2004/0182998 A1 * 9/2004 Denney et al. ..... 250/227.14
2004/0182999 A1 * 9/2004 Denney et al. ..... 250/227.14
2004/0186214 A1 * 9/2004 Li et al. ..... 524/474
2004/0196344 A1 * 10/2004 Hall et al. ..... 347/100
2004/0196345 A1 * 10/2004 Hall et al. ..... 347/100
2004/0207700 A1 * 10/2004 Hall et al. ..... 347/100
2004/0208212 A1 * 10/2004 Denney et al. ..... 372/38.02
2004/0233423 A1 * 11/2004 Nakayama et al. ..... 356/246
2005/0022806 A1 * 2/2005 Beaumont et al. ..... 128/200.14
2005/0040150 A1 * 2/2005 Denney et al. ..... 219/121.84
2005/0133100 A1 * 6/2005 Bolderheij et al. ..... 137/801
2005/0145745 A1 * 7/2005 Lewis et al. ..... 242/563
2005/0171634 A1 * 8/2005 York et al. ..... 700/231
2005/0171709 A1 * 8/2005 Nortier et al. ..... 702/45
2005/0197158 A1 * 9/2005 Silverbrook et al. ..... 455/556.2
2005/0200635 A1 * 9/2005 Silverbrook ..... 347/2
2005/0200638 A1 * 9/2005 Silverbrook et al. ..... 347/2
2005/0200893 A1 * 9/2005 Silverbrook et al. ..... 358/1.15
2005/0205612 A1 * 9/2005 Muderlak et al. ..... 222/333
2005/0205818 A1 * 9/2005 Bayley et al. ..... 251/129.04
2005/0218161 A1 * 10/2005 Muderlak et al. ..... 222/333
2005/0284366 A1 * 12/2005 Anderson et al. ..... 118/302
2006/0000110 A1 * 1/2006 Aisenberg et al. ..... 34/443
2006/0027138 A1 * 2/2006 Vonwiller et al. ..... 106/31.47
2006/0028520 A1 * 2/2006 Vonwiller et al. ..... 347/100
2006/0028714 A1 * 2/2006 Vonwiller et al. ..... 359/358
2006/0030638 A1 * 2/2006 Vonwiller et al. ..... 523/160
2006/0030639 A1 * 2/2006 Vonwiller et al. ..... 523/160
2006/0030701 A1 * 2/2006 Vonwiller et al. ..... 540/122
2006/0030703 A1 * 2/2006 Vonwiller et al. ..... 540/127
2006/0030704 A1 * 2/2006 Vonwiller et al. ..... 540/128
2006/0030705 A1 * 2/2006 Vonwiller et al. ..... 540/139
2006/0030706 A1 * 2/2006 Vonwiller et al. ..... 540/139
2006/0037494 A1 * 2/2006 Schrader et al. ..... 100/213
2006/0048800 A1 * 3/2006 Rast et al. ..... 134/56 R
2006/0062265 A1 * 3/2006 Denney et al. ..... 372/38.02
2006/0144833 A1 * 7/2006 Denney et al. ..... 219/121.78
2006/0144834 A1 * 7/2006 Denney et al. ..... 219/121.84
2006/0156978 A1 * 7/2006 Lipson et al. ..... 118/708
2006/0160074 A1 * 7/2006 Dorn et al. ..... 435/6
2006/0160250 A1 * 7/2006 Bonassar et al. ..... 438/1
2006/0173576 A1 * 8/2006 Goerg et al. ..... 700/236
2006/0180647 A1 * 8/2006 Hansen ..... 235/375
2006/0196861 A1 * 9/2006 Denney et al. ..... 219/121.78
2006/0231568 A1 * 10/2006 Lynn et al. ..... 222/52
2006/0249588 A1 * 11/2006 Walmsley et al. ..... 235/494
2006/0250461 A1 * 11/2006 Silverbrook et al. ..... 347/86
2006/0250488 A1 * 11/2006 King et al. ..... 347/109
2006/0251240 A1 * 11/2006 Silverbrook et al. ..... 379/357.01
2006/0253707 A1 * 11/2006 Lapstun et al. ..... 713/176
2006/0260183 A1 * 11/2006 Hockaday ..... 43/129
2006/0272170 A1 * 12/2006 Holmes ..... 34/275
2006/0272545 A1 * 12/2006 Vonwiller et al. ..... 106/31.46
2006/0278620 A1 * 12/2006 Denney et al. ..... 219/121.78
2006/0285108 A1 * 12/2006 Morrisroe ..... 356/316
2006/0286492 A1 * 12/2006 Morrisroe ..... 431/2
2007/0008392 A1 * 1/2007 Vonwiller et al. ..... 347/100
2007/0008393 A1 * 1/2007 Vonwiller et al. ..... 347/100
2007/0010645 A1 * 1/2007 Vonwiller et al. ..... 528/125
2007/0012028 A1 * 1/2007 Weissman et al. ..... 60/275
2007/0034113 A1 * 2/2007 Vonwiller et al. ..... 106/31.14
2007/0044680 A1 * 3/2007 Vonwiller et al. ..... 106/31.47
2007/0061040 A1 * 3/2007 Augenbraun et al. ..... 700/245
2007/0061043 A1 * 3/2007 Ermakov et al. ..... 700/263
2007/0079524 A1 * 4/2007 Sato et al. ..... 34/202
2007/0122622 A1 * 5/2007 Freedman ..... 428/408
2007/0135803 A1 * 6/2007 Belson ..... 606/1
2007/0144034 A1 * 6/2007 Kameishi ..... 34/523
2007/0178474 A1 * 8/2007 Cracauer et al. ..... 435/6
2007/0182976 A1 * 8/2007 Silverbrook ..... 358/1.12
2007/0189347 A1 * 8/2007 Denney et al. ..... 372/37
2007/0204925 A1 * 9/2007 Bolderheij et al. ..... 137/801
2007/0228703 A1 * 10/2007 Breed ..... 280/735
2007/0241125 A1 * 10/2007 Muderlak et al. ..... 221/71
2007/0266891 A1 * 11/2007 Vonwiller et al. ..... 106/31.49
2007/0299257 A1 * 12/2007 Vonwiller et al. ..... 540/140
2008/0004963 A1 * 1/2008 Montalbano et al. ..... 705/14
2008/0005833 A1 * 1/2008 Bayley et al. ..... 4/623
2008/0005855 A1 * 1/2008 Indusegaram et al. ..... 8/549
2008/0006177 A1 * 1/2008 Indusegaram et al. ..... 106/31.46
2008/0024563 A1 * 1/2008 Matsui et al. ..... 347/70
2008/0029691 A1 * 2/2008 Han ..... 250/224

2008/0052952 A1* 3/2008 Nelson ..... 34/554
2008/0053638 A1* 3/2008 Appleby et al. ..... 164/129
2008/0055381 A1* 3/2008 Doi et al. ..... 347/103
2008/0067331 A1* 3/2008 Denney et al. ..... 250/227.11
2008/0070994 A1* 3/2008 Li et al. ..... 514/788.1
2008/0073600 A1* 3/2008 Appleby et al. ..... 250/505.1
2008/0087192 A1* 4/2008 Starling et al. ..... 106/31.49
2008/0109956 A1* 5/2008 Bayley et al. ..... 4/623
2008/0118186 A1* 5/2008 Silverbrook et al. ..... 382/313
2008/0138674 A1* 6/2008 Pez et al. ..... 429/17
2008/0161046 A1* 7/2008 Walmsley et al. ..... 455/556.1
2008/0170103 A1* 7/2008 Silverbrook et al. ..... 347/50
2008/0173147 A1* 7/2008 Kovarik et al. ..... 83/62
2008/0173810 A1* 7/2008 Morrisroe ..... 250/288
2008/0177792 A1* 7/2008 Ridley et al. ..... 707/104.1
2008/0178819 A1* 7/2008 Sia et al. ..... 119/300
2008/0179507 A2* 7/2008 Han ..... 250/224
2008/0185399 A1* 8/2008 Yang et al. ..... 222/52
2008/0216342 A1* 9/2008 Kameishi et al. ..... 34/202
2008/0240178 A1* 10/2008 Denney et al. ..... 372/24
2008/0261220 A1* 10/2008 Cracauer et al. ..... 435/6
2008/0263889 A1* 10/2008 Fukaya et al. ..... 34/267
2008/0266357 A1* 10/2008 Silverbrook et al. ..... 347/50
2008/0303658 A1* 12/2008 Melker et al. ..... 340/540
2008/0307779 A1* 12/2008 El-Malki et al. ..... 60/299
2008/0316260 A1* 12/2008 Silverbrook et al. ..... 347/42
2008/0320309 A1* 12/2008 Lapstun et al. ..... 713/176
2009/0000024 A1* 1/2009 Louis et al. ..... 4/676
2009/0000140 A1* 1/2009 Collins ..... 34/89
2009/0021731 A1* 1/2009 Denney et al. ..... 356/318
2009/0035469 A1* 2/2009 Sue et al. ..... 427/282
2009/0035533 A1* 2/2009 Starling et al. ..... 428/195.1
2009/0041634 A1* 2/2009 Cracauer et al. ..... 422/135
2009/0054664 A1* 2/2009 Vonwiller et al. ..... 548/416
2009/0061094 A1* 3/2009 Vonwiller et al. ..... 427/288
2009/0061179 A1* 3/2009 Vonwiller et al. ..... 428/211.1
2009/0067002 A1* 3/2009 Silverbrook et al. ..... 358/1.15
2009/0077736 A1* 3/2009 Loberger et al. ..... 4/623
2009/0098908 A1* 4/2009 Silverbrook et al. ..... 455/556.1
2009/0119942 A1* 5/2009 Aisenberg et al. ..... 34/418
2009/0119981 A1* 5/2009 Drozd et al. ..... 44/544
2009/0121031 A1* 5/2009 Hall et al. ..... 235/494
2009/0130745 A1* 5/2009 Williams et al. ..... 435/287.2
2009/0155123 A1* 6/2009 Williams et al. ..... 422/65
2009/0193571 A1* 8/2009 Nakamura et al. ..... 4/300
2009/0193573 A1* 8/2009 Nakamura et al. ..... 4/320
2009/0217447 A1* 9/2009 Matsushita et al. ..... 4/420.5
2009/0221059 A1* 9/2009 Williams et al. ..... 435/287.2
2009/0242642 A1* 10/2009 Starling et al. ..... 235/462.01
2009/0255986 A1* 10/2009 Starling et al. ..... 235/375
2009/0256889 A1* 10/2009 Silverbrook et al. ..... 347/50
2009/0257071 A1* 10/2009 Silverbrook et al. ..... 358/1.6
2009/0266877 A1* 10/2009 Vonwiller et al. ..... 235/375
2009/0267776 A1* 10/2009 Glenn et al. ..... 340/573.1
2009/0272028 A1* 11/2009 Drozd et al. ..... 44/569
2009/0272405 A1* 11/2009 Barnhill et al. ..... 134/18
2009/0273477 A1* 11/2009 Barnhill ..... 340/573.1
2009/0284739 A1* 11/2009 Denney et al. ..... 356/318
2009/0284809 A1* 11/2009 Vonwiller et al. ..... 358/474
2009/0288601 A1* 11/2009 Bi et al. ..... 118/722
2009/0299787 A1* 12/2009 Barnhill ..... 705/7
2009/0301523 A1* 12/2009 Barnhill et al. ..... 134/18
2009/0306822 A1* 12/2009 Augenbraun et al. ..... 700/245
2010/0012597 A1* 1/2010 David et al. ..... 210/774
2010/0021867 A1* 1/2010 Altshuler et al. ..... 433/215
2010/0078415 A1* 4/2010 Denney et al. ..... 219/121.69
2010/0081471 A1* 4/2010 Silverbrook ..... 455/556.1
2010/0096777 A1* 4/2010 Appleby et al. ..... 264/318
2010/0096778 A1* 4/2010 Appleby et al. ..... 264/318
2010/0118200 A1* 5/2010 Gelman et al. ..... 348/578
2010/0125269 A1* 5/2010 Emmons et al. ..... 606/33
2010/0139572 A1* 6/2010 Sia et al. ..... 119/346
2010/0159163 A1* 6/2010 Indusegaram et al. ..... 428/29
2010/0163623 A1* 7/2010 Mays et al. ..... 235/462.01
2010/0189887 A1* 7/2010 Nielsen et al. ..... 427/136
2010/0194797 A1* 8/2010 Vonwiller et al. ..... 347/6
2010/0196604 A1* 8/2010 Kariya et al. ..... 427/288
2010/0204602 A1* 8/2010 Addington et al. ..... 600/538
2010/0205728 A1* 8/2010 Muhlhausen et al. ..... 4/223
2010/0208014 A1* 8/2010 Indusegaram et al. ..... 347/86
2010/0210745 A1* 8/2010 McDaniel et al. ..... 521/55
2010/0233499 A1* 9/2010 Vonwiller et al. ..... 428/537.5
2010/0245086 A1* 9/2010 Nielsen et al. ..... 340/540
2010/0247754 A1* 9/2010 Nielsen et al. ..... 427/137
2010/0253468 A1* 10/2010 Devecka ..... 340/3.1
2010/0255182 A1* 10/2010 Nielsen et al. ..... 427/8
2010/0256825 A1* 10/2010 Nielsen et al. ..... 700/283
2010/0262470 A1* 10/2010 Nielsen et al. ..... 705/11
2010/0263571 A1* 10/2010 Vonwiller et al. ..... 106/31.49
2010/0263591 A1* 10/2010 Nielsen et al. ..... 118/708
2010/0268381 A1* 10/2010 Goerg et al. ..... 700/244
2010/0288788 A1* 11/2010 Ophardt ..... 222/1
2010/0295909 A1* 11/2010 Doi et al. ..... 347/86
2010/0320379 A1* 12/2010 Morrisroe ..... 250/288
2010/0327239 A1* 12/2010 Lapstun et al. ..... 252/587
2011/0023751 A1* 2/2011 Indusegaram et al. ..... 106/31.49
2011/0027550 A1* 2/2011 Vonwiller et al. ..... 428/211.1

FOREIGN PATENT DOCUMENTS

DE 4218658 A1 * 12/1992
FR 2853591 A1 * 10/2004
GB 2225505 A * 5/1990
JP 01075728 A * 3/1989
JP 01075730 A * 3/1989
JP 01075732 A * 3/1989
JP 01075733 A * 3/1989
JP 01075734 A * 3/1989
JP 01075735 A * 3/1989
JP 01075736 A * 3/1989
JP 4-51671 Y2 12/1992
JP 6-62981 A 3/1994
JP 8-164087 A 6/1996
JP 08277564 A * 10/1996
JP 9-23995 A 1/1997
JP 11-318760 A 11/1999
JP 2001137150 A * 5/2001
JP 2003-47567 A 2/2003
JP 2004-97740 A 4/2004
JP 2004-154288 A 6/2004
JP 2005-177151 A 7/2005
JP 2010179127 A * 8/2010
WO WO 9953250 A1 * 10/1999
WO WO 03/006079 A1 * 1/2003
WO WO 2007013142 A1 * 2/2007

OTHER PUBLICATIONS

PCT/ISA/237, for PCT/JP2005/013652 dated Oct. 2005.

* cited by examiner

HAND DRYING APPARATUS

TECHNICAL FIELD

The present invention relates to a hand drying apparatus that hygienically dries wet hands after washing, and more particularly to a hand drying apparatus that can prevent improper operations with a high accuracy, when a person approaches to the dryer.

BACKGROUND ART

As an apparatus that dries wet hands after washing, there are hand drying apparatus that blow away water on hands to dry the hands using fast airflow. The hand drying apparatus have a box formed with a hand insertion portion in a recessed shape as a hand drying space, and air nozzles are arranged on the hand insertion portion. The air nozzles are connected with an air duct, connected to a high pressure airflow generator, thereby discharging fast airflow in the hand insertion portion. Water is blown away in the hand drying space by the hand drying, and the water drops from a water drain port provided on a bottom of the hand insertion portion to a drain container provided below the hand insertion portion to be received in the container.

The hand drying apparatus are often constituted such that a hand detector constituted of an infrared light emitter and an infrared light receiver is provided on a wall face that forms the hand drying space. When insertion of hands into the hand drying space is detected by the hand detector, fast airflow is discharged based on a detection signal from the hand detector.

As an arrangement system for the infrared light emitter and the infrared light receiver, there is a detection system of a transmission type where the infrared light emitter and the infrared light receiver are respectively arranged on, for example, a front side wall face and a rear side wall face forming the hand drying space so as to be opposed to each other, and presence of hands is detected based on whether light to the receiver is interrupted. In the detecting system of the transmission type, however, since the infrared light emitter and the infrared light receiver are arranged at different positions, the structure of a main unit of the detecting system is complicated, which causes such a problem as increase in pressure loss in an air duct, or increase in cost of the main unit.

Patent document 1 discloses a hand detector of a reflected light detection type where an infrared light emitter and an infrared light receiver that detect hands inserted into a hand drying space are arranged on the same wall face. In the Patent document 1, such a constitution is employed that the infrared light emitter and the infrared light receiver provided on the same wall face are obliquely aimed on a position below and inside an air outlet, so that a hand detecting range is limited and improper operations are prevented even if a person other than a user of the hand drying apparatus approaches to its main unit.

Patent Document 1: Japanese Patent Application Laid-open No. H11-318760

DISCLOSURE OF INVENTION

Problem to be Solved by the Invention

However, in the conventional hand drying apparatus disclosed in the Patent document 1, since reflection of infrared lights from the wall face forming the drying space is not particularly taken into consideration, infrared lights leaving outside from the main unit due to diffuse reflection thereof on the wall face forming the drying space increase, which results in a high possibility that, when a person other than a user of the hand drying apparatus approaches to the main unit, an improper operation occurs such that the light receiver detects the person and starts a drying operation.

In the Patent document 1, although a reference value for comparison with a received light intensity is set higher than a value obtained when a person approaches to the main unit, to prevent improper operations that can occur when a person approach around the main unit. However, a detection range of hands is reduced to be narrow by setting of the reference value for comparison with a received light intensity to be higher.

The present invention has been made in view of the above, and has an object to provide a hand drying apparatus in which improper operations can be prevented with a high accuracy when a person other than a user comes near the apparatus and that makes it possible to achieve a wide hand detection range.

Means for Solving Problem

To solve the above problems and to achieve the objects, according to an aspect of the present invention, a hand drying apparatus includes a high pressure airflow generator configured to generate high pressure airflow; a nozzle that discharges the high pressure airflow generated by the high pressure airflow generator; a drying space forming unit that has a hand insertion portion that allows insertion and pulling-out of hands and is formed with a drying space where hands inserted through the hand insertion portion is dried by the high pressure airflow discharged from the nozzle; and at least one hand detector constituted of an infrared light emitter and an infrared light receiver for detecting hands inserted into the drying space that are arranged on the same wall face of the drying space forming unit, wherein driving of the high pressure airflow generator is controlled based on a detection signal from the hand detector, and an infrared light absorber whose infrared light reflectivity is smaller than that of hands and absorbs infrared lights is formed on at least a portion of the wall face of the drying space forming unit that is opposed to the infrared light emitter of the hand detector.

Effect of the Invention

According to the present invention, since the infrared light absorber whose infrared light reflectivity is smaller than that of hands and that absorbs infrared lights is formed on the wall face opposed to the infrared light emitter in the dry space forming unit, infrared lights emitted from the infrared light emitter are substantially absorbed in the infrared absorber, so that improper operations due to diffuse reflection of infrared lights when a person other than a user of the hand drying apparatus approaches to the main unit can be prevented with a high accuracy. Since it is unnecessary to make the hand detection range narrow, which is different from the conventional technique, the hand drying apparatus according to the present invention can be used comfortably without stopping the operation thereof during its use.

EXPLANATIONS OF LETTERS OR NUMERALS

Figure 1:
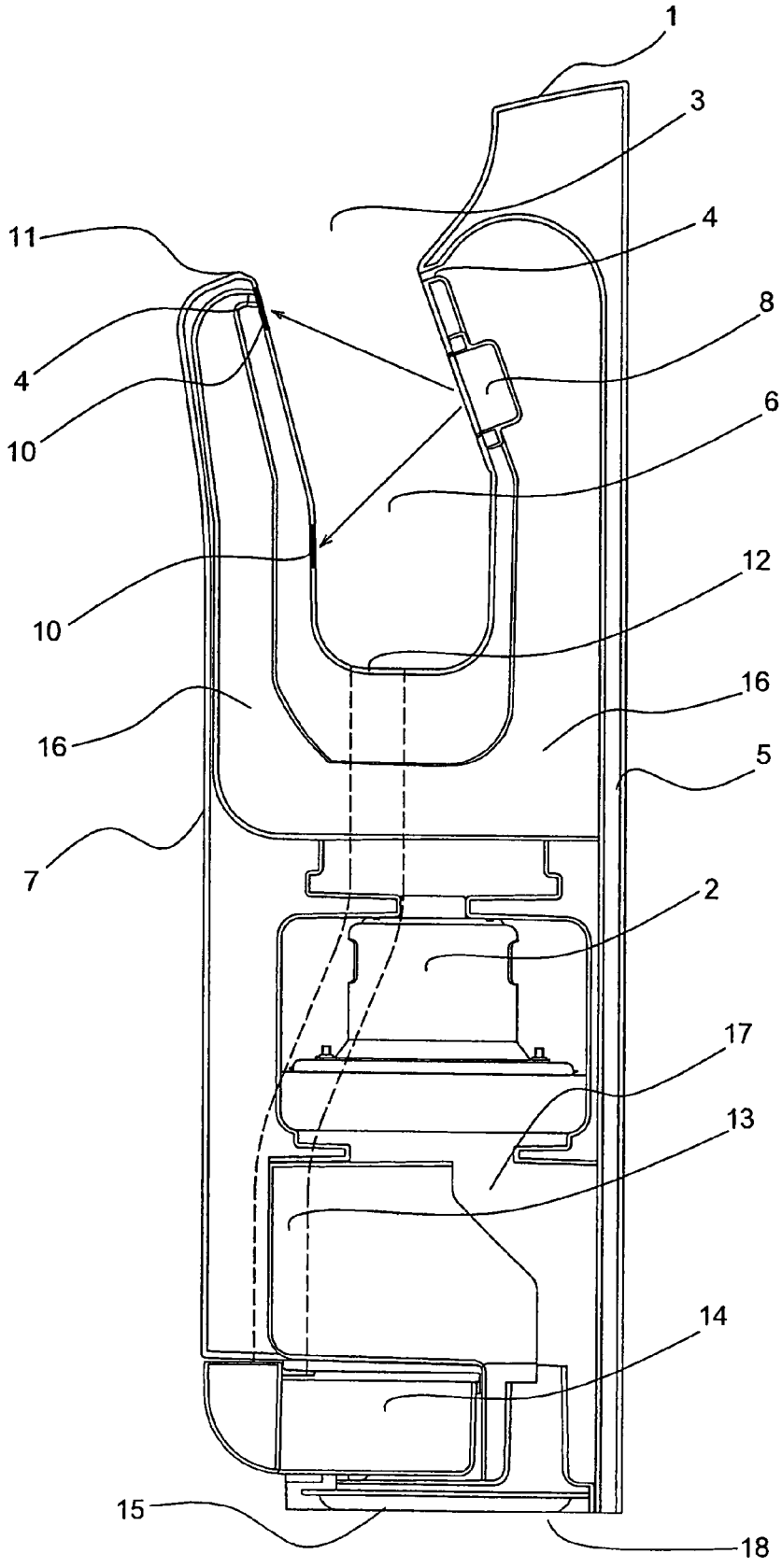
FIG. 1 is a right side cross-section of a hand drying apparatus according to a first embodiment.

1 Main unit box member
2 High pressure airflow generator
3 Hand insertion portion
4 Air nozzle
5 Base
6 Drying space
7 Front panel
8 Hand detector
9 Infrared ray emitter
10 Infrared ray absorber
12 Drain port
13 Drainage pipe
14 Drain container
15 Air filter
16 Air duct
18 Air intake port
19 Infrared ray receiver
20 Infrared ray emitter
21 Hand

BEST MODE(S) FOR CARRYING OUT THE INVENTION

Exemplary embodiments of a hand drying apparatus according to the present invention will be explained below with reference to the accompanying drawings. Note that the invention is not limited by the embodiments.

First Embodiment

Figure 2:
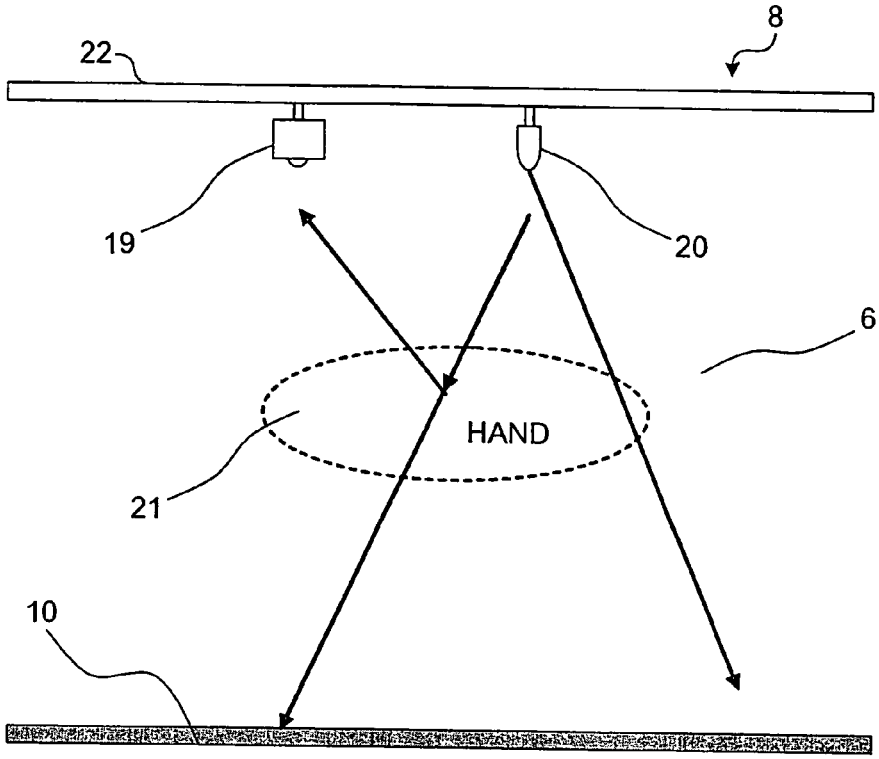
FIG. 2 is a schematic diagram of the hand drying apparatus according to the first embodiment.
Figure 3:
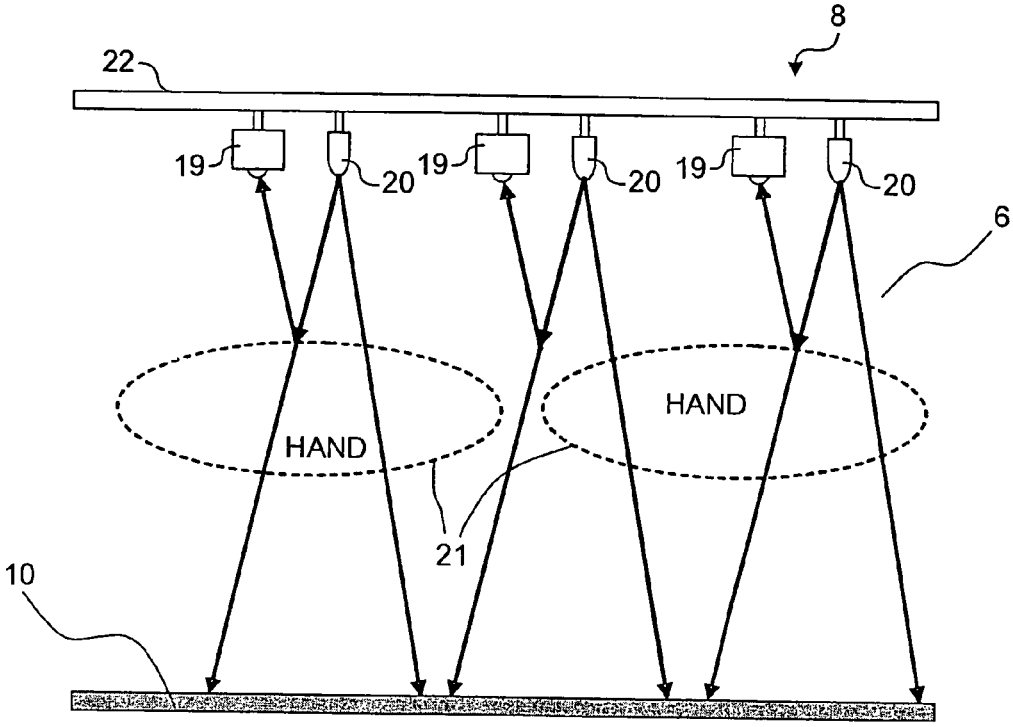
FIG. 3 is a schematic diagram of the hand drying apparatus according to the first embodiment.

A hand drying apparatus according to a first embodiment of the present invention will be explained with reference to FIG. 1 to FIG. 3. FIG. 1 is a right side cross-section of a hand drying apparatus according to the first embodiment. FIGS. 2 and 3 are plan views of parts of a hand detector.

As shown in FIG. 1, the hand drying apparatus has a main unit box member 1 constituted of a base 5 forming a rear face outer shell and a front panel 7 forming a front face outer shell. A recessed space serving as a hand insertion portion 3 and a drying space 6 is formed on an upper side of the main unit box member 1. The recessed space is formed in an open sink shape with both sides opened and hands can be inserted.

A high pressure airflow generator 2 is assembled in the main unit box member 1, and a high pressure airflow generated by the high pressure airflow generator 2 is guided to air nozzles 4 provided on a front side wall face and a rear side wall face around the hand insertion portion 3 via air ducts 16. Fast airflows are discharged from the air nozzles 4 into the drying space 6 to blow away water on hands inserted into the hand insertion portion 3 into the drying space 6 and collect blown water in a water receiver with an inclined bottom of the recessed space, thereby pooling the collected water into a drain container 14 via a drain port 12 formed at an inclined lower end.

A drainage pipe 13 that conveys water is connected to the drain port 12. The drain container 14 with an open container structure that collects water conveyed through the drainage pipe 13 is provided. The drain container 14 can be detachable by taking-in and -out thereof in forward and backward directions. The drain container 14 is provided with a removable lid. The drain container 14 and the lid are made from chemical resistant PP, ABS resin or the like, and they can be cleaned using mild detergent, alcohol, or the like. Furthermore, water-shedding coating such as silicon-base coating or fluorine-base, hydrophilic coating such as titanium oxide coating is applied to, or anti-bacteria agent is impregnated in the wall face forming the drying space 6, so that reduction of stain adhesion or growth of bacteria can be achieved.

The high pressure airflow generator 2 is constituted of a DC brushless motor (which can be an ordinary commutator motor or an induction motor), a driving circuit that drives the DC brushless motor, and a turbofan rotated by the DC brushless motor, and it is provided just below the hand insertion portion 3 in this embodiment. Reference numeral 17 denotes a suction port of a blower and reference numeral 18 denotes an air intake port provided below the box member 1, where the air intake port 18 can suck air via a detachable air filter 15.

A hand detector 8 is provided on a rear face side of the wall face forming the drying space 6, so that presence of hands inserted into the drying space 6 via the hand insertion portion 3 is detected based on a detection signal from the hand detector 8. The hand detector 8 includes an infrared light emitter 20 and an infrared light receiver 19, a base board (not shown) on which the infrared light emitter 20 and the infrared light receiver 19 are mounted, a holder (not shown) that holds the base board, and a cover (not shown) that prevents water or the like from entering, and allows transmission of an infrared light signal. As shown in FIG. 2 or FIG. 3, the hand detector 8 is provided with a set of or plural sets of infrared light emitters 20 and infrared light receivers 19 arranged on the same wall face, and it adopts a detector constitution of a reflection type where light emitted from the infrared light emitters 20 is reflected by a hand 21 and the reflected light is detected by the infrared light receivers 19 so that the presence of hands is detected.

As shown in FIG. 2, the hand detector can be constituted of a set of infrared light emitters 20 and the infrared light receiver 19, or it can be constituted of plural sets of infrared light emitters 20 and the infrared light receiver 19, as shown in FIG. 3. The number of sets to be arranged can be determined according to a required detection range.

A detection signal from the infrared light receiver 19 is input into a control circuit (not shown) including a microcomputer, and the control circuit compares a value of the detection signal from the infrared light receiver 19 and a predetermined reference value. When the detection signal value is larger than the reference value, it is determined that hands are inserted into the drying space. When the control circuit determines that the hand are inserted, it causes a current to flow to the high pressure airflow generator 2 to discharge fast airflow from the air nozzles 4 and start an operation. The control circuit stops the operation when reflection of light from the hands is not detected and the value of the detection signal from the infrared light receiver becomes lower than the reference value.

As shown in FIG. 1 to FIG. 3, an infrared light absorber 10 whose infrared light reflectivity is smaller than that of hands and that absorbs infrared lights, is provided at least a portion of an inner wall face forming the drying space 6 that is opposed to the infrared light emitter 20 of the hand detector 8. In this case, since the hand detector 8 is provided on a rear side inner wall face of the inner wall forming the drying space 6, the infrared light absorber 10 is provided on the inner wall face on the front side. The infrared light absorbers 10 are provided at two positions different in height in the case shown in FIG. 1, and two infrared light emitters 20 are arranged so as to be opposed to the two positions. The infrared light absorber 10 is provided at only a portion of the inner wall face forming the drying space 6 that is opposed to the infrared light emitter 20 in the case shown in FIG. 1. However, the infrared light absorber 10 can be provided on the whole inner wall face forming the drying space 6. Although constitution including one hand detector 8 and two infrared light absorbers 10 is employed in the case shown in FIG. 1, plural sets of hand detectors can be arranged in the drying space according to need, for example, in a vertical direction.

Preferably, the infrared light absorber 10 has a small reflectivity to infrared lights and a large absorptance, and it can be formed by applying a color material with dense concentration such as black, or by using a substance or a material having a surface with a deep color.

In the above constitution, reflection from the infrared light absorber 10 is reduced when hands are not inserted and infrared lights are hardly input on the infrared light receiver 19. When the hand 21 is inserted into the drying space 6, reflected light from the infrared light emitter 20 is reflected by the hand 21 to be input into the infrared light receiver 19, so that the microcomputer mounted on the control circuit detects the presence of the hand and starts an operation.

When a person other than a user of the hand drying apparatus approaches to the main unit, such a case can occur that, when the infrared light absorber 10 is not provided on the wall face in the drying space 6, infrared lights from the infrared light emitter 20 are diffusely reflected in the drying space 6, and they are output outside of the main unit, and the output infrared lights to the outside are reflected by the person, so that an improper operation is caused. When a reference value for operation start is set higher to prevent the improper operation like a conventional technique, an amount of reflection light must be increased and it results in narrowing a hand detection range. However, when the infrared light absorber 10 is provided on the wall face in the drying space 6 that is opposed to the infrared light emitter 20 like this embodiment, light is hardly output to the outside, so that a reference value applied for operation can be set low, and the hand detection range can be widened.

As a conventional hand detection system, there is also a system where an infrared light emitter and an infrared light receiver are disposed on discrete positions to be opposed to a wall face forming a drying space, the presence of hands is detected by interrupting light to the receiver, and an operation is started. In this system, it is necessary to provide hand detectors on a front side and a rear side of a main unit facing the drying space, respectively. Furthermore, it is necessary to arrange the hand detectors around the nozzles to achieve excellent detection. When the above arrangement is adopted, since it is necessary to arrange the hand detector at a position where the air duct is partially closed to have a good detecting position for stating an operation, there is a first problem that pressure loss in the air duct increases. Since it is necessary to arrange the hand detector at the uppermost position on the front side of the main unit to have a good detecting position for stopping the operation, there is a second problem that a hand insertion position must be set higher, which results in lower usability.

Since the hand detector can be arranged unitarily on either one of the front side and the rear side by adopting the hand detector based on the reflection system, a structure around the air duct can be simplified, so that cost reduction can be achieved and pressure loss in the air duct can be improved. The hand detector 8 is not required to be arranged at the front side uppermost portion 11 of the main unit; however, it can be arranged in a depth side in the drying space 6, as shown in FIG. 1, which results in improvement in usability. As shown in FIG. 3, even when a lateral size of the main unit is made longer by increasing the number of infrared light receivers 19 and infrared light emitters 20, the hand detection range can be set in the drying space 6.

In the above reflection type, if a distance between the front side wall face and the rear side wall face forming the drying space 6 is long (about 150 millimeters), since a difference in a reflection amount of infrared lights from a wall face between a time when hands are inserted and a time when hands are out can be secured sufficiently, so that provision of a hand detector of the reflection type solves the problems. However, if the distance between the wall faces is short (about 40 to 100 millimeters), since a difference in a reflection amount of infrared lights from the wall face between the time when hands are inserted and the time when hands are out cannot be secured sufficiently, so that an excellent detection sensitivity cannot be obtained.

One approach to solve this problem and obtain excellent detection sensitivity, in a hand drying apparatus where the distance of the drying space 6 is short, is to use an infrared light absorber whose reflectivity is lower than that of hands, at a portion opposed to the infrared light emitter.

To improve insertion feeling and usability when hands are inserted, it is desirable to make the space between the front panel 7 and the inner wall face forming the drying space 6 small. When hand detectors are arranged on a front face side and a rear face side, respectively, the spacing between the front panel 7 and the inner wall face becomes large due to the hand detector on the front face side, which results in deterioration of insertion feeling and usability. Therefore, the hand detector can be arranged unitarily on the rear face side of the drying space by using a combination of the hand detectors 8 of the reflection type and the infrared light absorber, so that excellent usability can be achieved.

Figure 4:
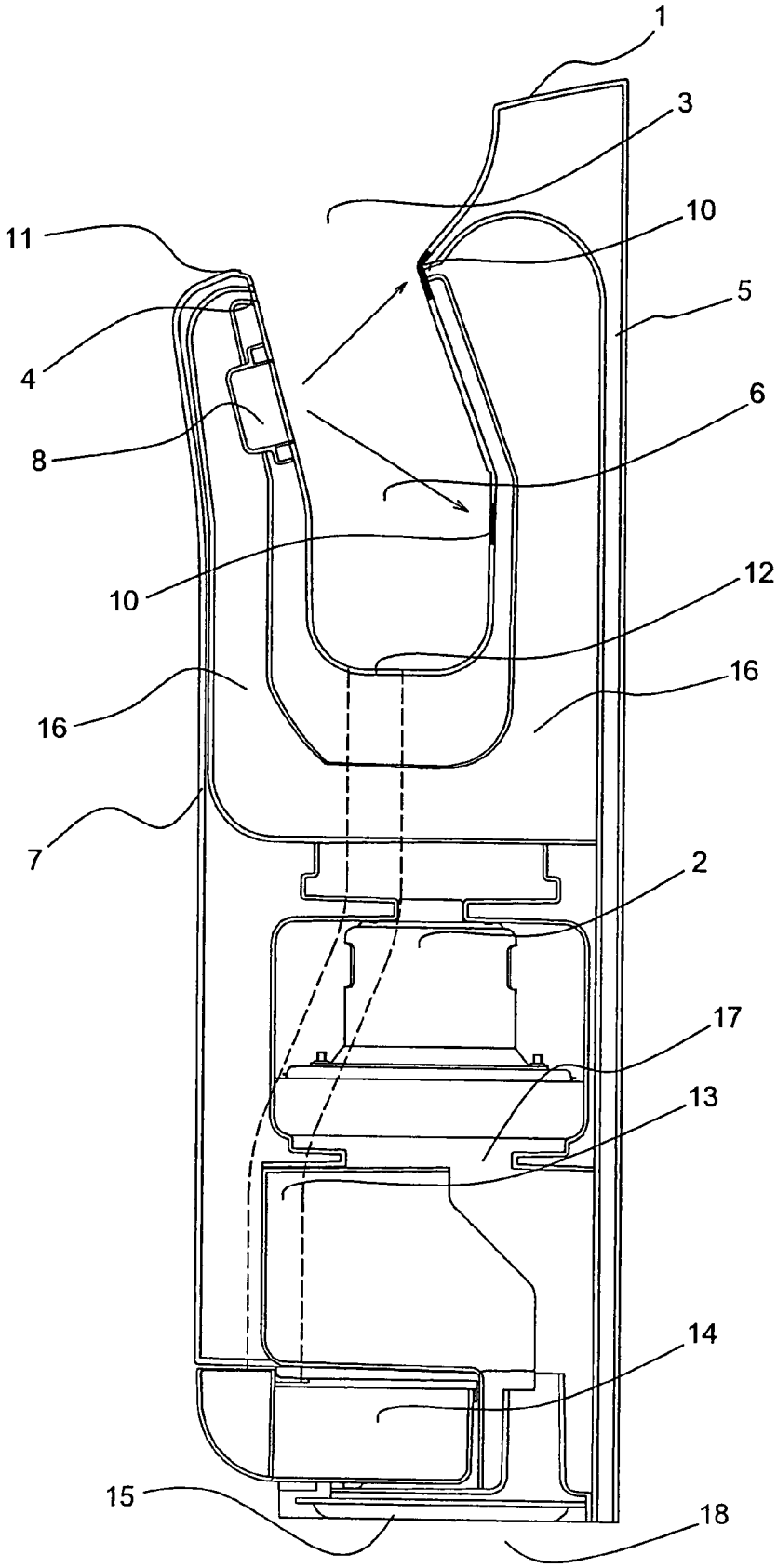
FIG. 4 is a right side cross-section of a variant of the hand drying apparatus according to the first embodiment.

FIG. 4 depicts a variant of the hand drying apparatus according to the first embodiment. In FIG. 4, the hand detector 8 is disposed on an inner wall face on the front face side of the drying space 6. In this case, since the hand detector 8 is arranged on the inner wall face on the front face side of the drying space 6, the infrared light absorber 10 is arranged on a portion of the inner wall face forming the drying space 6 that is positioned on the rear face side.

Second Embodiment

A hand drying apparatus of a second embodiment of the present invention will be explained next with reference to FIG. 5. In the second embodiment, the hand detector 8 constituted of the infrared light emitter 20 and the infrared light receiver 19 is arranged on the rear face side in the drying space 6 and an infrared light emitter 9 is provided at a front position opposed to the infrared light receiver 19 of the hand detector 8, and hands inserted near the hand insertion portion 3 in the drying space 6 is detected by a reflection type constitution including the infrared light emitter 20 and the infrared light receiver 19 built in the hand detector 8, while hands inserted into deeper in the drying space 6 is detected by a transmission type constitution including the infrared light emitter 9 and the infrared light receiver 19. Infrared rays A and B emitted from the infrared light emitter 20 and the infrared light emitter 9 and received by the infrared light receiver 19 can be discriminated properly by performing timing control or wavelength discrimination.

This case is a system where hands are detected by interrupting either one of infrared lights A and B from the infrared light emitter 20 and the infrared light emitter 9, where when hands are inserted to a point of infrared lights B, a signal is sent to the micro-computer mounted on the control circuit so that the high pressure airflow generator 2 starts operation. Since the infrared light A is emitted around the hand insertion portion 3, even when hands are positioned near the hand insertion portion 3, the operation is continued and the operation is reliably stopped when hands are out.

Thus, in the second embodiment, hands inserted into the drying space 6 are detected by cooperation of a combination of the infrared light emitter of the reflection type and the infrared light receiver, and a combination of the infrared light emitter of the transmission type and the infrared light receiver. The infrared light absorber 10 is provided at the portion opposed to the infrared light emitter of the reflection type.

Figure 5:
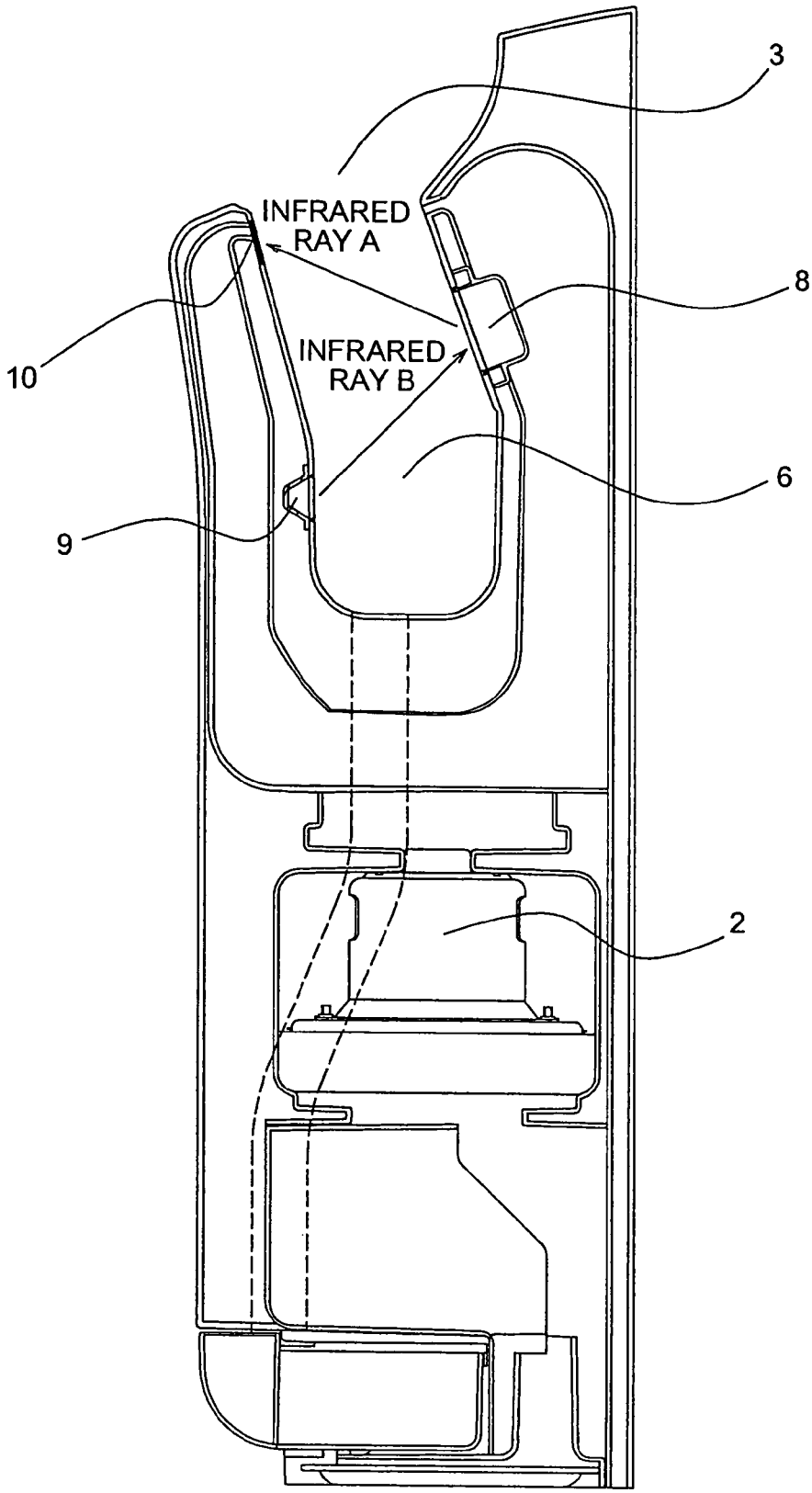
FIG. 5 is a right side cross-section of a hand drying apparatus according to a second embodiment.

While the case shown in FIG. 5 is constituted such that infrared lights generated from the infrared light emitters 20 and 9 are commonly received by the infrared light receiver 19 in the hand detector 8, an infrared light receiver that exclusively receives infrared lights generated from the infrared light emitter 9 can be separately provided on the rear face side in the drying space 6. Furthermore, such a constitution can be employed that an exclusive infrared light emitter for performing transmission type detection is provided on the wall face side (on the rear face side in FIG. 5) provided with the hand detector 8 and an infrared light receiver that receives infrared lights from the exclusive infrared light emitter is provided at a portion (on the front face side in FIG. 5) opposed to the exclusive infrared light emitter via the drying space 6.

INDUSTRIAL APPLICABILITY

As described above, the hand drying apparatus according to the present invention is useful in a hand drying apparatus provided with a hand detector that detects inserted hands using an infrared light emitter and an infrared light receiver.

The invention claimed is:

1. A hand drying apparatus comprising:

a high pressure airflow generator configured to generate high pressure airflow;

a nozzle that discharges the high pressure airflow generated by the high pressure airflow generator;

a drying space that has a hand insertion portion having wall faces that allow insertion and pulling-out of hands and is formed so hands inserted through the hand insertion portion are dried by the high pressure airflow discharged from the nozzle;

at least one hand detector constituted of an infrared light emitter and an infrared light receiver configured to detect hands inserted into the drying space that are arranged on a same wall face of the drying space, wherein driving of the high pressure airflow generator is controlled based on a detection signal from the hand detector; and an infrared light absorber whose infrared light reflectivity is smaller than that of hands and absorbs infrared light, formed on at least a portion of a wall face of the drying space unit that is opposed to the infrared light emitter of the hand detector.

2. The hand drying apparatus according to claim 1, wherein the hand detector is provided unitarily on a rear face side of the drying space.

3. The hand drying apparatus according to claim 1, wherein color or material whose infrared light reflectivity is smaller than that of hands is used for the infrared light absorber.

4. The hand drying apparatus according to claim 2, wherein color or material whose infrared light reflectivity is smaller than that of hands is used for the infrared light absorber.

5. The hand drying apparatus according to claim 2, wherein a distance between a front face side and a rear face side of the drying space is between 40 millimeters and 100 millimeters.

6. The hand drying apparatus according to claim 2, wherein a distance between a front face side and a rear face side of the drying space is between 40 millimeters and 100 millimeters.

7. The hand drying apparatus according to claim 3, wherein a distance between a front face side and a rear face side of the drying space is between 40 millimeters and 100 millimeters.

8. The hand drying apparatus according to claim 4, wherein a distance between a front face side and a rear face side of the drying space is between 40 millimeters and 100 millimeters.

9. The hand drying apparatus according to claim 1, further comprising any one or both of an infrared light emitter and an infrared light receiver opposed to each other across the drying space, wherein hands inserted into the drying space are detected by cooperation of any one or both of the infrared light emitter and the infrared light receiver opposed to each other and the hand detector with each other.

* * * * *